US010612539B2

(12) United States Patent
Zubia et al.

(10) Patent No.: US 10,612,539 B2
(45) Date of Patent: Apr. 7, 2020

(54) ROD CLAMP ASSEMBLY AND METHOD

(71) Applicant: Neo Design Group, LLC, Midland, TX (US)

(72) Inventors: Alberto Zubia, Midland, TX (US); Daniel Robert Vasquez, Spring, TX (US)

(73) Assignee: NEO Design Group, LLC, Midland, TX (US)

( * ) Notice: Subject to any disclaimer, the term of this patent is extended or adjusted under 35 U.S.C. 154(b) by 70 days.

(21) Appl. No.: 15/956,120

(22) Filed: Apr. 18, 2018

(65) Prior Publication Data

US 2019/0323495 A1 Oct. 24, 2019

(51) Int. Cl.

| | |
|---|---|
| ***E21B 17/10*** | (2006.01) |
| ***E21B 19/12*** | (2006.01) |
| ***F04B 53/14*** | (2006.01) |
| ***E21B 19/24*** | (2006.01) |

(52) U.S. Cl.

CPC ..... *F04B 53/144* (2013.01); *E21B 17/1071* (2013.01); *E21B 19/12* (2013.01); *E21B 19/24* (2013.01)

(58) Field of Classification Search

CPC ..... E21B 19/12; E21B 19/24; E21B 17/1071; F04B 53/144

See application file for complete search history.

(56) References Cited

U.S. PATENT DOCUMENTS 1,718,072 A * 6/1929 Quarnstrom ..... E21B 19/12 279/106

3,144,794 A * 8/1964 Foster ..... E21B 19/167 81/56

* cited by examiner

*Primary Examiner* — Giovanna C Wright
*Assistant Examiner* — Yanick A Akaragwe
(74) *Attorney, Agent, or Firm* — Jones Walker LLP

(57) ABSTRACT

A rod clamp assembly including a first clamp member pivotally connected to a second clamp member, a handle pivotally connected to the first clamp member, and a lock bolt pivotally connected to the handle. The first and second clamp members each include a semi-cylindrical groove. A lock end of the lock bolt is configured to engage a receptacle of the second clamp member to pull the first and second clamp members together. An elongated portion of the handle is rotated to a locked position in which the first and second clamp members are secured together. A base of the handle, which engages the first clamp member, may include a notch for providing a quick close and quick open. Optionally, the rod clamp assembly includes a safety lock assembly, which engages the elongated portion of the handle to secure the handle in the locked position.

20 Claims, 18 Drawing Sheets

ROD CLAMP ASSEMBLY AND METHOD

BACKGROUND OF THE INVENTION

Reciprocating piston pumps used in oil and gas wells typically include a pump jack at the well surface and a downhole pump disposed at the bottom of the well. The downhole pump is connected to the pump jack by a series of interconnected sucker rods. The uppermost joint in the string of sucker rods is a polished rod, which enables an efficient hydraulic seal around the reciprocating rod string. Polished rod clamps are used to fasten the polished rod to a bridle of the pump jack. The polished rod clamp holds the weight of the sucker rod string. Conventional rod clamps include pivoting clamp members secured together with a bolt and a nut. The installation of conventional rod clamps is a lengthy process as each rod clamp includes two or three bolts, and each must be tightened to a required torque using tools to tighten the bolt.

DETAILED DESCRIPTION OF THE PREFERRED EMBODIMENTS

A rod clamp assembly of the present disclosure includes a first clamp member pivotally connected to a second clamp member, a handle pivotally connected to the first clamp member, and a lock bolt pivotally connected to the handle. The first and second clamp members each include a semi-cylindrical groove. The rod clamp assembly is secured to a rod by positioning the rod between the first and second clamp members with the rod clamp assembly in the open position. With the rod disposed in the semi-cylindrical grooves of the first and second clamp members, the rod clamp assembly is placed in the closed position by engaging a receptacle of the second clamp member with a lock end of the lock bolt. In this way, the lock end of the lock bolt engages the receptacle of the second clamp member to pull the first and second clamp members together. An elongated portion of the handle is then rotated to place the rod clamp assembly in the locked position in which the first and second clamp members are secured together. In some embodiments, the rod clamp assembly includes a safety lock assembly, which engages the elongated portion of the handle to secure the handle in the locked position.

Figure 1:
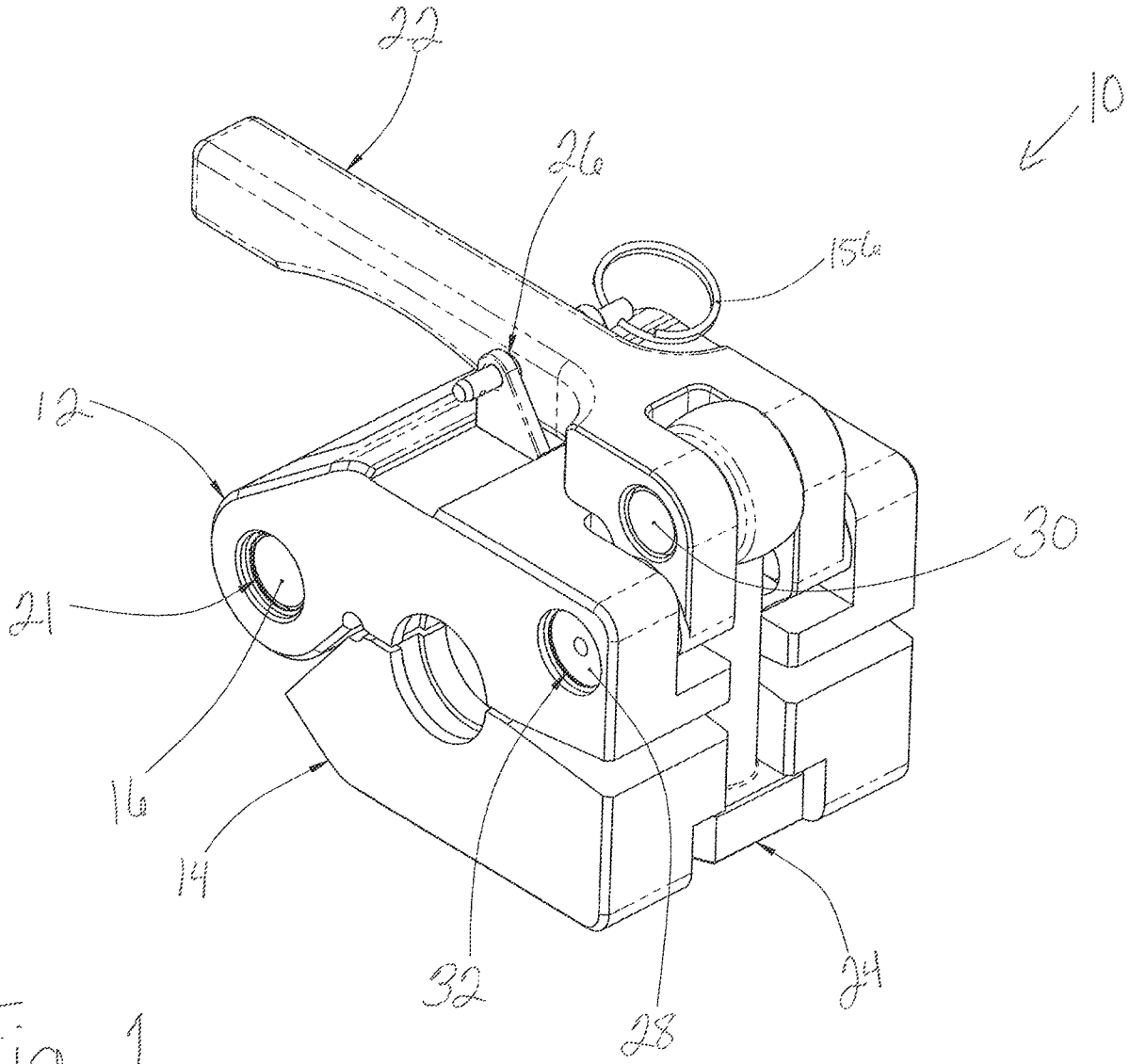
FIG. 1 is a perspective view of a rod clamp assembly.
Figure 2:
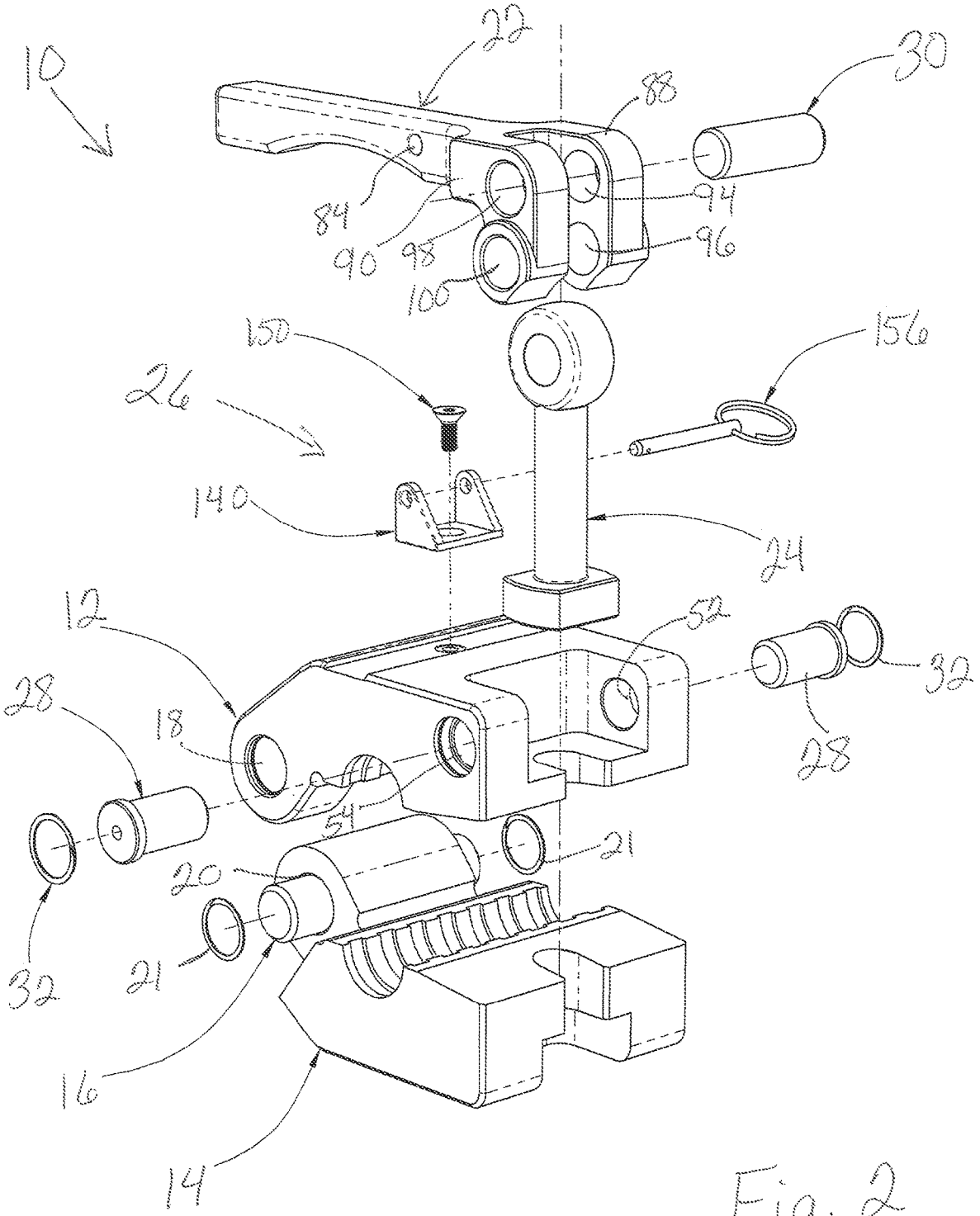
FIG. 2 is an exploded view of the rod clamp assembly.

FIGS. 1 and 2 illustrate one embodiment of the rod clamp assembly. Rod clamp assembly 10 includes first clamp member 12 and second clamp member 14. First and second clamp members 12 and 14 are pivotally attached together. In one embodiment, pin 16 is disposed through bores 18 in first clamp member 12 and bore 20 in second clamp member 14 to pivotally secure first and second clamp members 12 and 14 together. Pin 16 may be secured within bores 18, 20 with retaining rings 21.

Rod clamp assembly 10 further includes handle 22, lock bolt 24, and, optionally, safety lock assembly 26. Handle 22 is pivotally connected to first clamp member 12, and lock bolt 24 is pivotally connected to handle 22. In one embodiment, handle 22 is pivotally connected to first clamp member 12 with two clamp pins 28, and lock bolt 24 is pivotally connected to handle 22 with pin 30. Each clamp pin 28 may be secured within the bores of first clamp member 12 with one of the retaining rings 32.

Figure 3:
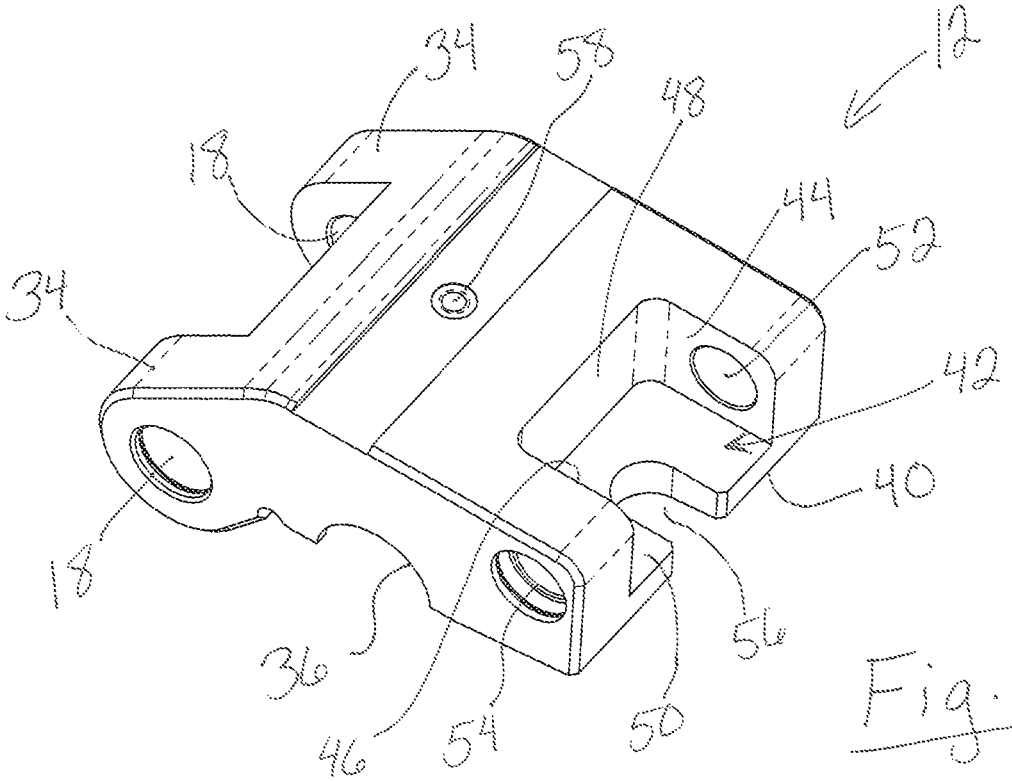
FIG. 3 is a top perspective view of a first clamp member of the rod clamp assembly.
Figure 4:
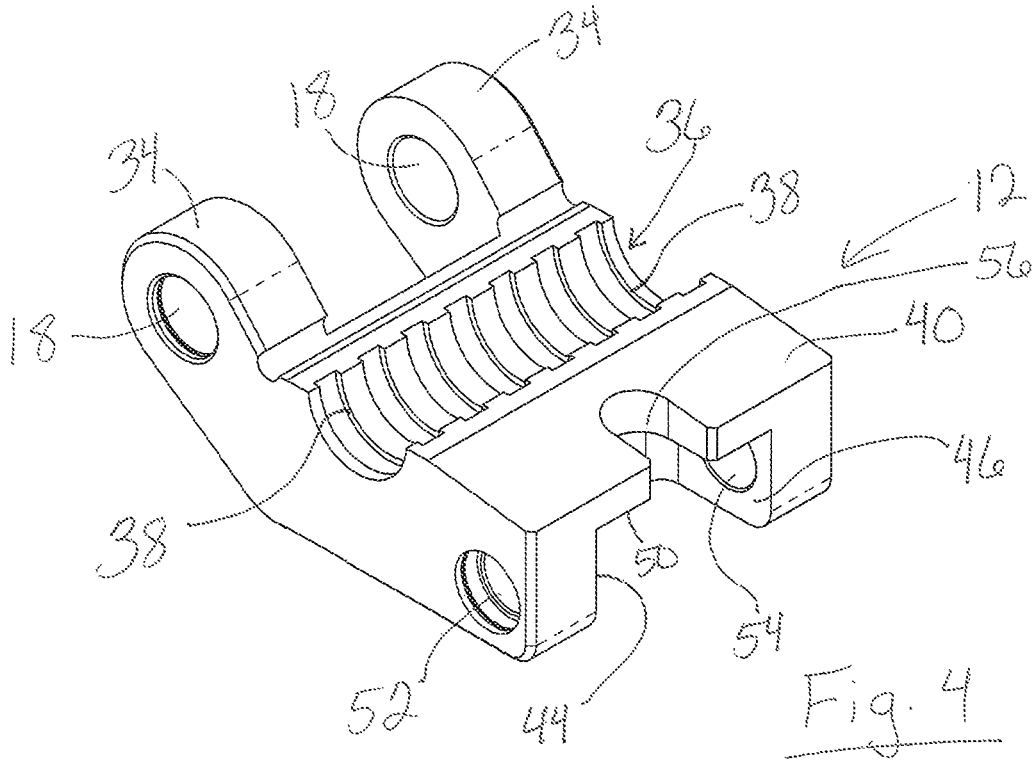
FIG. 4 is a bottom perspective view of the first clamp member.

With reference to FIGS. 3 and 4, first clamp member 12 may include two spaced apart pivot arms 34 each including bore 18. First clamp member 12 may also include semi-cylindrical groove 36, which may include grips 38 (or grip sections) on the inner surface of semi-cylindrical groove 36. Semi-cylindrical groove 36 may be disposed between pivot arms 34 and distal surface 40. First clamp member 12 may further include receptacle 42 defined by side walls 44 and 46 and rear wall 48. Walls 44, 46, and 48 may each extend from receptacle floor 50. Side wall 44 may include bore 52, and side wall 46 may include bore 54. Bores 52 and 54 may be dimensioned to receive a pin, such as clamp pins 28 (shown in FIGS. 1 and 2). Recess 56 extending from receptacle floor 50 to distal surface 40 may extend into receptacle. Recess 56 is dimensioned to receive a portion of lock bolt 24 (shown in FIGS. 1 and 2). In one embodiment, recess 56 is a U-shaped opening. In some embodiments, first clamp member 12 includes aperture 58 between pivot arms 34 and receptacle 42.

Figure 5:
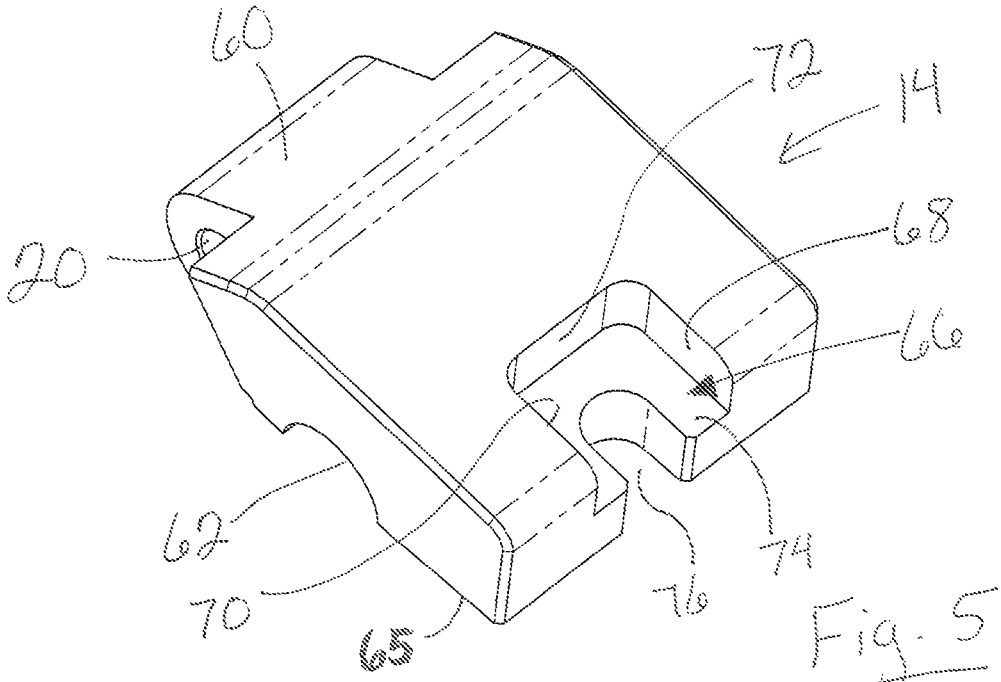
FIG. 5 is a bottom perspective view of a second clamp member of the rod clamp assembly.
Figure 6:
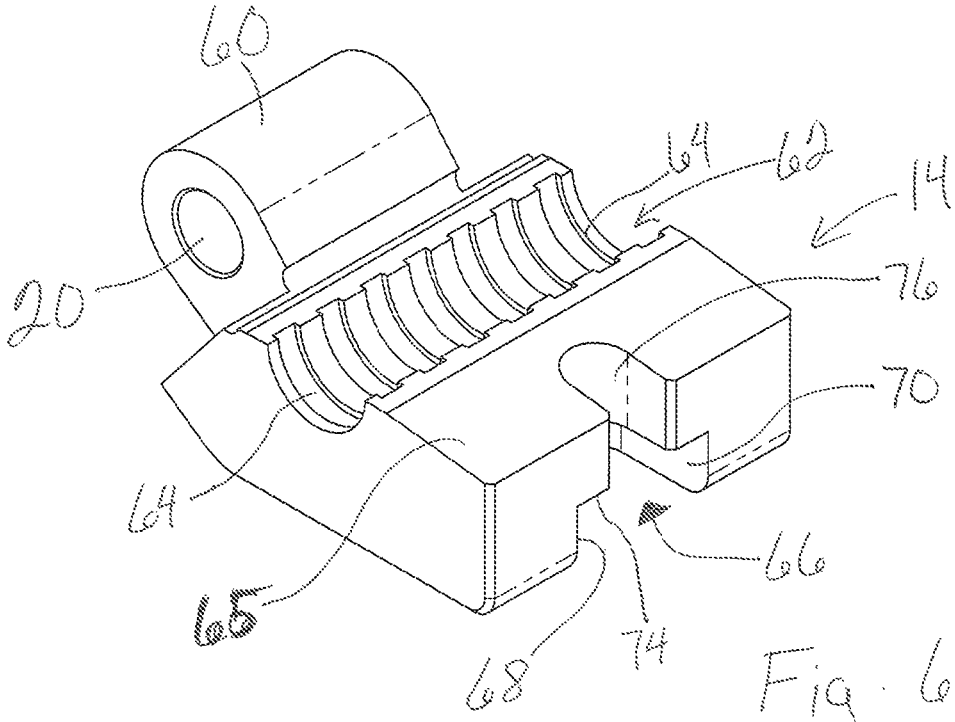
FIG. 6 is a top perspective view of the second clamp member.

Referring to FIGS. 5 and 6, second clamp member 14 may include pivot arm 60 including bore 20. When assembled, pivot arm 60 of second clamp member 14 may be disposed between pivot arms 34 of first clamp member 12 to align bores 18 and 20. Second clamp member 14 may also include semi-cylindrical groove 62, which may include grips 64 (or grip sections) on the inner surface of semi-cylindrical groove 62. Semi-cylindrical groove 62 may be disposed between pivot arm 60 and distal surface 65. Second clamp member 14 may further include receptacle 66 defined by side walls 68 and 70 and rear wall 72. Walls 68, 70, and 72 may each extend from receptacle floor 74. Recess 76 extending from receptacle floor 74 to distal surface 65 may extend into receptacle 66. Recess 76 is dimensioned to receive a portion of lock bolt 24 (shown in FIGS. 1 and 2). In one embodiment, recess 76 is a U-shaped opening.

Figure 7:
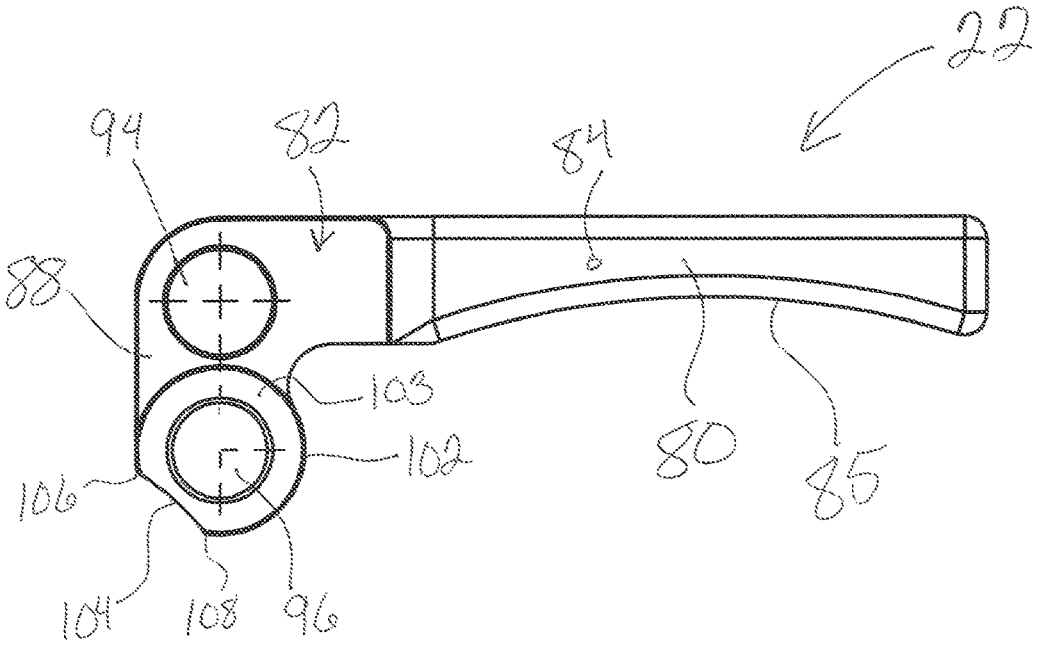
FIG. 7 is a side view of a handle of the rod clamp assembly.
Figure 8:
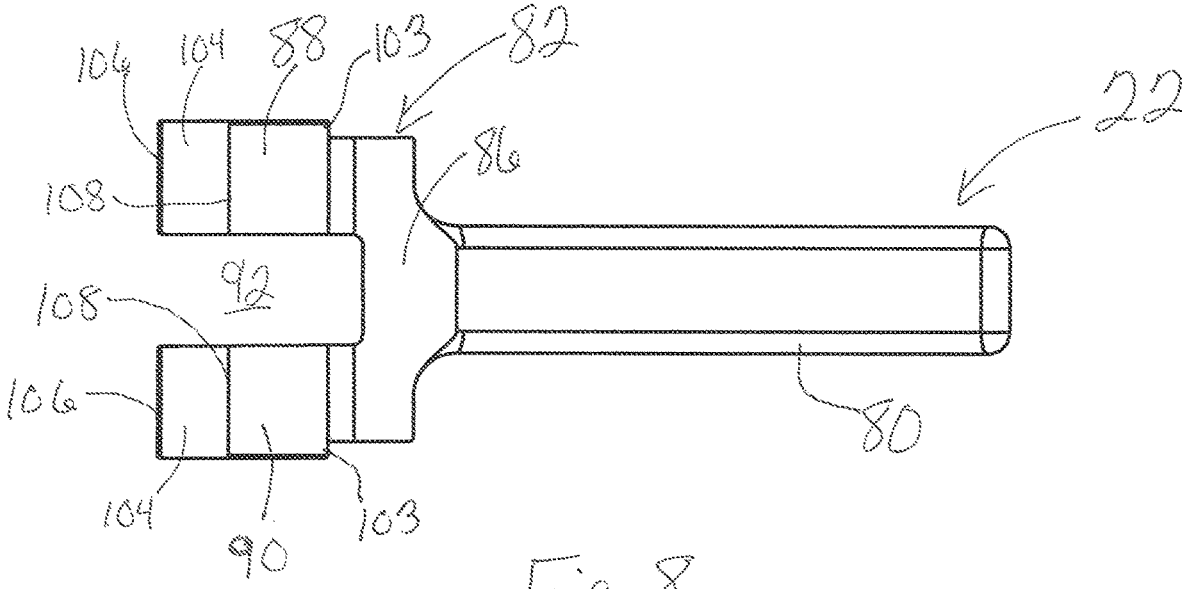
FIG. 8 is a bottom view of the handle.

With reference to FIGS. 7 and 8, handle 22 includes elongated portion 80 extending from handle base 82. Elongated portion 80 may include lateral bore 84 extending through the width of elongated portion 80. Elongated portion 80 may be configured for griping by a user. For example, elongated portion 80 may include concave lower surface 85, thereby providing a smaller gripping area in the center of elongated portion 80 than at its distal end. Handle base 82 includes bridge 86 adjacent to elongated portion 80. Handle base 82 also includes two prongs 88 and 90 extending from bridge 86 and separated by central space 92. Prong 88 includes lock bolt bore 94 and clamp bore 96. Prong 90 includes lock bolt bore 98 and clamp bore 100 (shown in FIG. 2). Prongs 88 and 90 each includes a generally round profile surface 102 surrounding clamp bores 96 and 100. In one embodiment, prongs 88 and 90 may each include an expanded portion 103 around clamp bores 96 and 100. Expanded portion 103 of prongs 88 and 90 may have a larger width than the remainder of each prong 88 and 90, such as the portion of prongs 88 and 90 surrounding lock bolt bores 94 and 98, respectively.

Prongs 88 and 90 may each further include notch 104 proximate clamp bores 96 and 100, respectively. Each notch 104 may be formed by a concave surface extending from first inflection line 106 to second inflection line 108 on generally round profile surface 102, as shown in FIGS. 7 and 8. Alternatively, each notch 104 may be formed by a flat surface extending from first inflection line 106 to second inflection line 108. In another alternate embodiment, each notch 104 may be formed by a convex surface extending from first inflection line 106 to second inflection line 108, with this section having a larger radius than the remainder of the generally round profile surface 102.

Handle base 82 may be partially disposed in receptacle 42 of first clamp member 12 as shown in FIGS. 1 and 2. Clamp bores 96 and 100 of prongs 88 and 90 may be aligned with bores 52 and 54 of first clamp member 12, respectively. One clamp pin 28 is secured within bore 54 of first clamp member 12 and within bore 100 of prong 90 of handle 22. The second clamp pin 28 is secured within bore 52 of first clamp member 12 and within bore 96 of prong 88 of handle 22. In this way, handle base 82 is pivotally secured to receptacle 42 of first clamp member 12. In embodiments including expanded portion 103, the outer surface of each expanded portion 103 of prongs 88 and 90 may engage side walls 44 and 46, respectively, as handle 22 rotates about clamp pins 28 relative to first clamp member 12.

Figure 9:
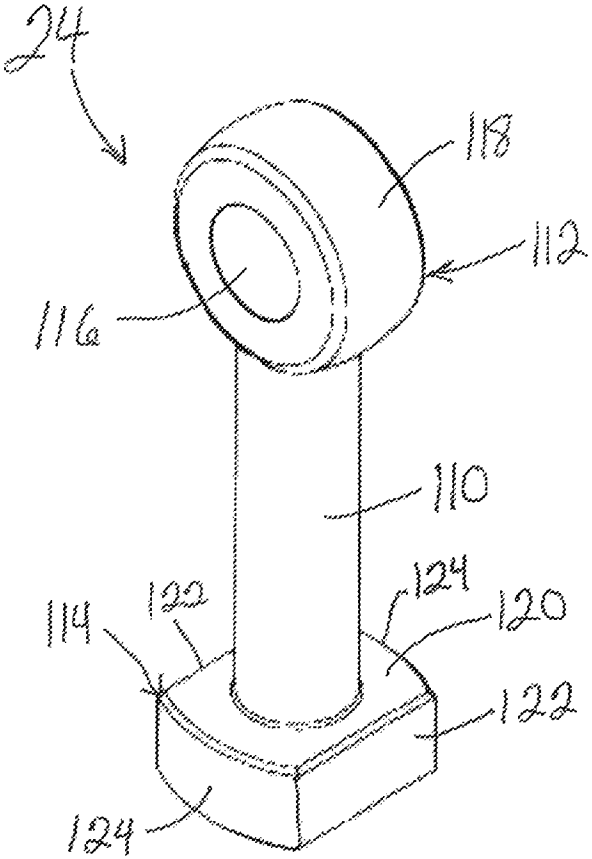
FIG. 9 is a side view of a lock bolt of the rod clamp assembly.

Referring now to FIG. 9, lock bolt 24 may include elongated portion 110 extending from lock base 112 to lock end 114. Elongated portion 110 may be a generally cylindrical member. Lock base 112 may include central bore 116 surrounded by flat surfaces generally round profile surface 118. Lock end 114 may include inner surface 120 adjacent to elongated portion 110 and flat side surfaces 122 interconnected by curved side surfaces 124.

Lock base 112 may be disposed in central space 92 between prongs 88 and 90 of handle 22 (as shown in FIGS. 1 and 2). Central bore 116 of lock base 112 may be aligned with lock bolt bores 94 and 98 of prongs 88 and 90, respectively. Pin 30 may be secured through lock bolt bore 94 of prong 88 of handle 22, through central bore 116 of lock base 112, and through lock bolt bore 98 of prong 90 of handle 22. In this way, lock bolt 24 is pivotally connected to handle base 82. In the closed position, inner surface 120 of lock end 114 may engage receptacle floor 74 of receptacle 66 of second clamp member 14. In this way, lock bolt 24 holds first and second clamp members 12 and 14 together. In one embodiment, lock bolt 24 includes elongated portion 110 integrally formed with lock base 112 and lock end 114.

Figure 10:
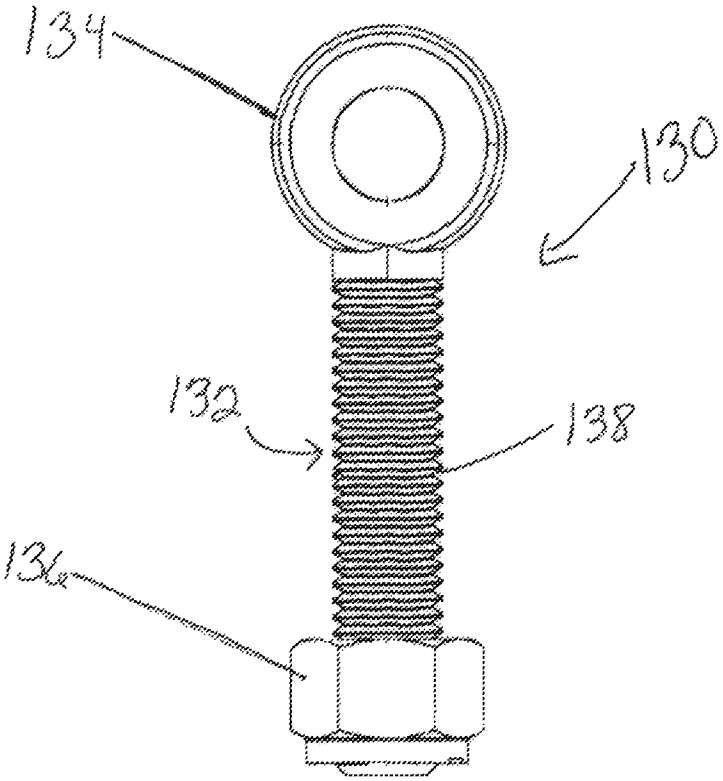
FIG. 10 is a side view of an alternate embodiment of the lock bolt.

FIG. 10 illustrates alternate lock bolt 130. Lock bolt 130 may include elongated portion 132 extending from lock base 134 to lock end 136. Elongated portion 132 may be a generally cylindrical member with threaded outer surface 138. Lock base 134 may include the same features as lock base 112. Lock end 136 may be formed of nut configured to threadedly engage threaded outer surface 138 of elongated portion 132 to adjust the distance between lock base 134 and lock end 136 in use. In this way, alternate lock bolt 130 is an adjustable lock bolt. Lock end 136 may engage receptacle floor 74 of receptacle 66 of second clamp member 14. In this way, alternate lock bolt 130 may hold first and second clamp members 12 and 14 together.

Figure 11:
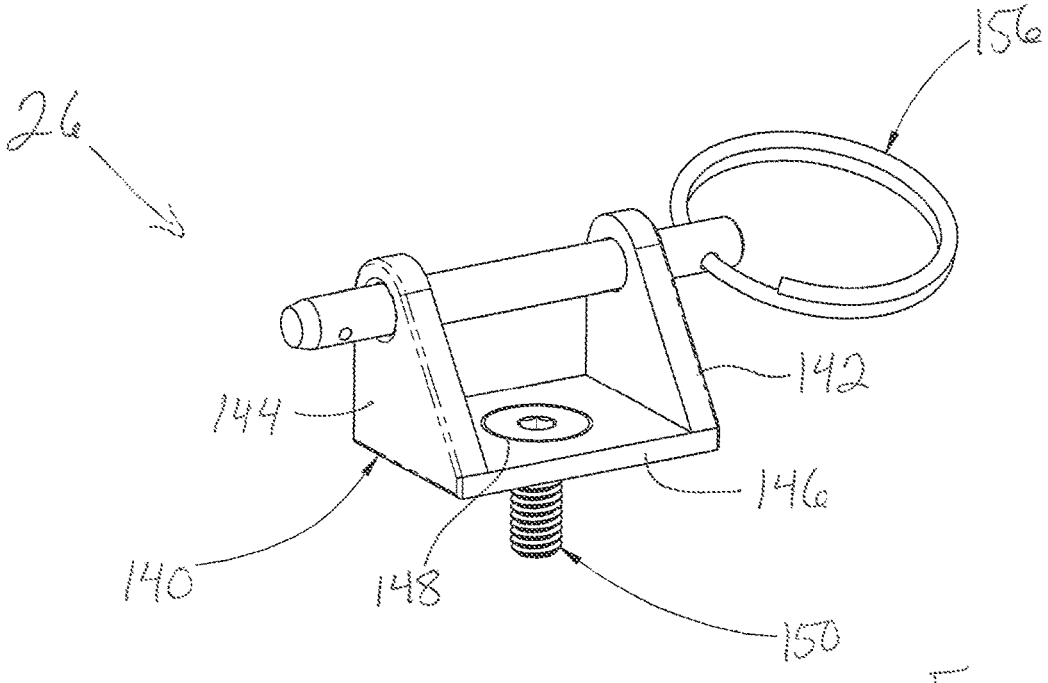
FIG. 11 is a perspective view of a safety lock assembly of the rod clamp assembly.
Figure 12:
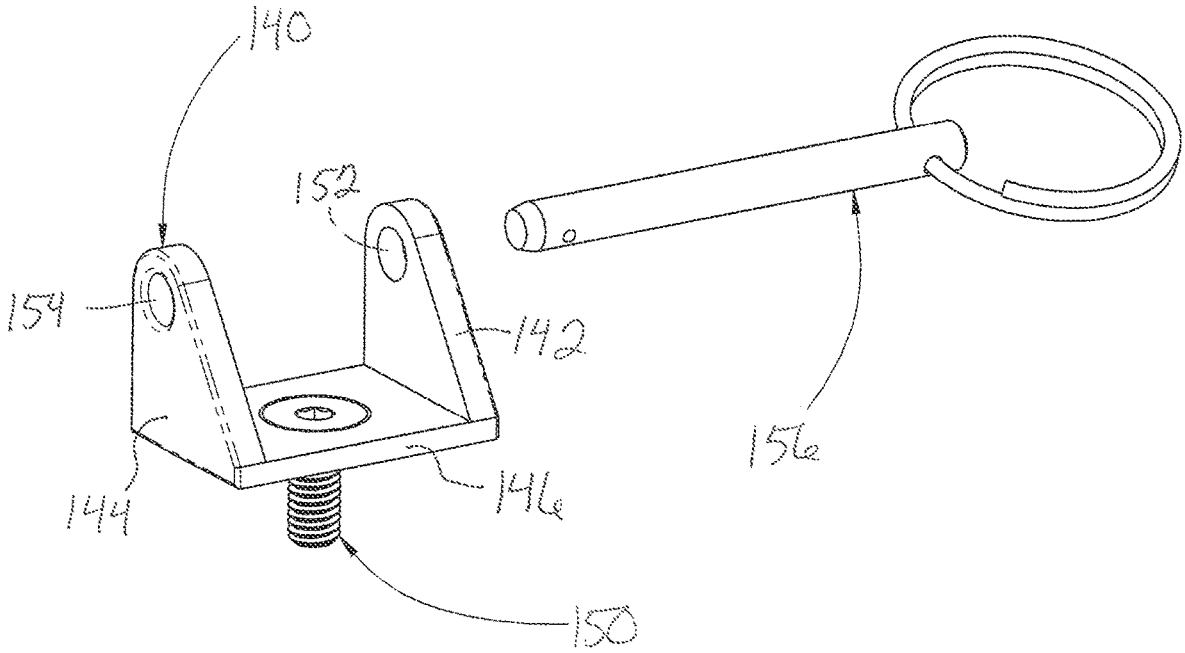
FIG. 12 is an exploded view of the safety lock assembly.
Figure 13:
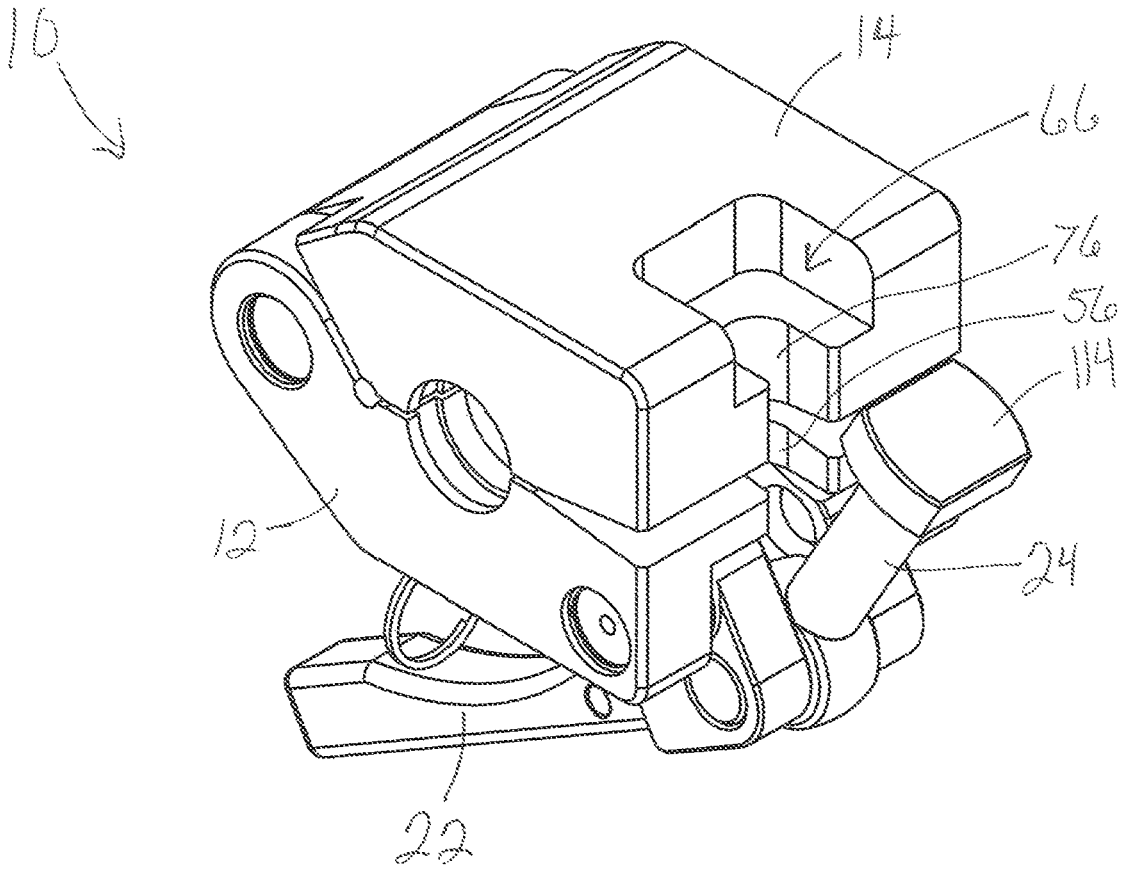
FIG. 13 is a perspective view of the rod clamp assembly in an open position.

With reference to FIGS. 11 and 12, safety lock assembly 26 may include bracket 140 including first segment 142 and second segment 144 extending from base plate 146. Base plate 146 may be configured to be secured to first clamp member 12. In one embodiment, base plate 146 includes opening 148 dimensioned to receive a fastener, such as fastener 150. The fastener may be any fastener suitable for securing base plate 146 to first clamp member 12. Alternatively, base plate 146 may be formed with no opening, and base plate 146 may be secured to first clamp member 12 by any suitable fastening mechanism, such as by welding, glue, adhesive, or any other method. First segment 142 may include bore 152, and second segment 144 may include bore 154 aligned with bore 152. Bores 152 and 154 are dimensioned to receive safety pin 156 therethrough.

In the embodiments including opening 148 and fastener 150, bracket 140 may be secured to first clamp member 12 by aligning opening 148 with aperture 58 of first clamp member 12 (shown in FIG. 3). Fastener 150 may then be secured through opening 148 and aperture 58 to secure bracket 140 to first clamp member 12. In a locked position illustrated in FIG. 1, elongated portion 80 of handle 22 is at least partially disposed between first segment 142 and second segment 144 of bracket 140. In this position, lateral bore 84 of handle 22 may be aligned with bores 152 and 154 of first and second segments 142 and 144, respectively. A user may insert safety pin 156 through bore 152, lateral bore 84, and bore 154 to secure handle 22 in the locked position. In an alternate embodiment, the safety lock assembly may include a bracket that automatically grips elongated portion 80 of handle 22 when placed in the locked position shown in FIG. 1.

FIGS. 13-16 illustrate rod clamp assembly 10 in an open position. In this position, lock bolt 24 does not engage receptacle 66 of second clamp member 14. As shown in FIG.

13, recesses 56 and 76 of first and second clamp members 12 and 14, respectively, provide a space for elongated portion 110 of lock bolt 24.

Figure 15:
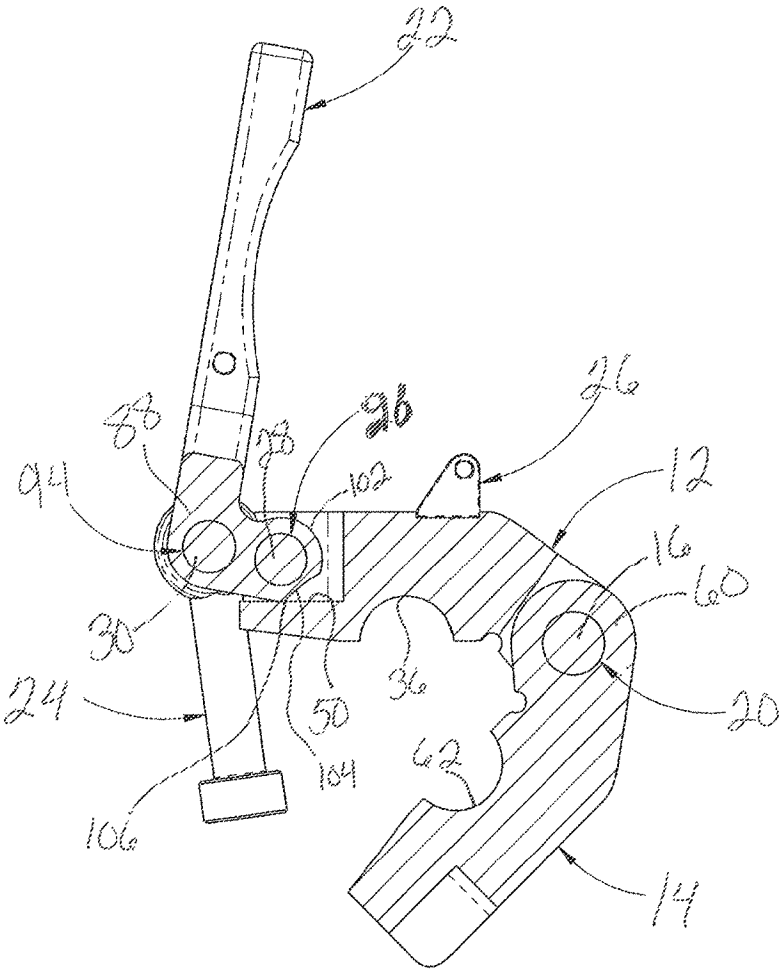
FIG. 15 is a sectional view of the rod clamp assembly in the open position, taken along line A-A in FIG. 14.
Figure 14:
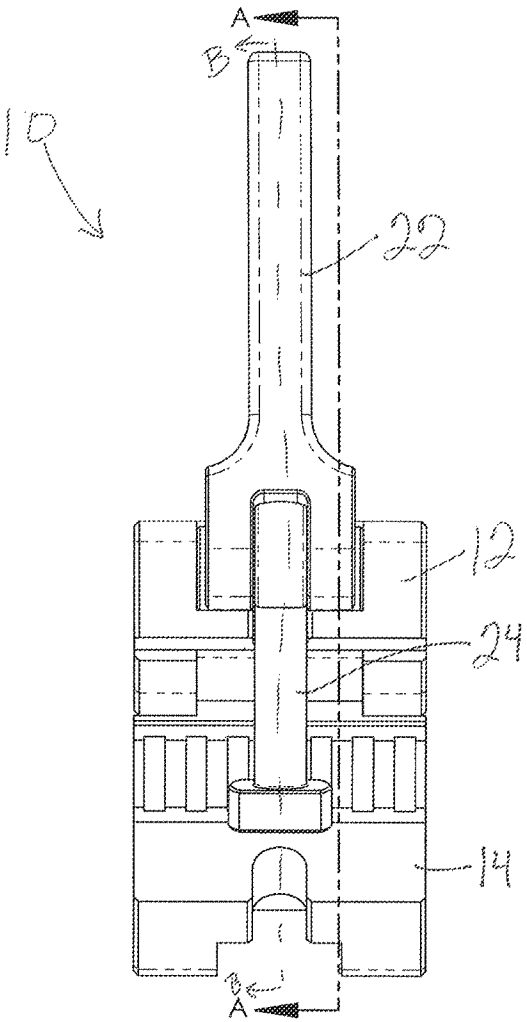
FIG. 14 is an end view of the rod clamp assembly in the open position.
Figure 16:
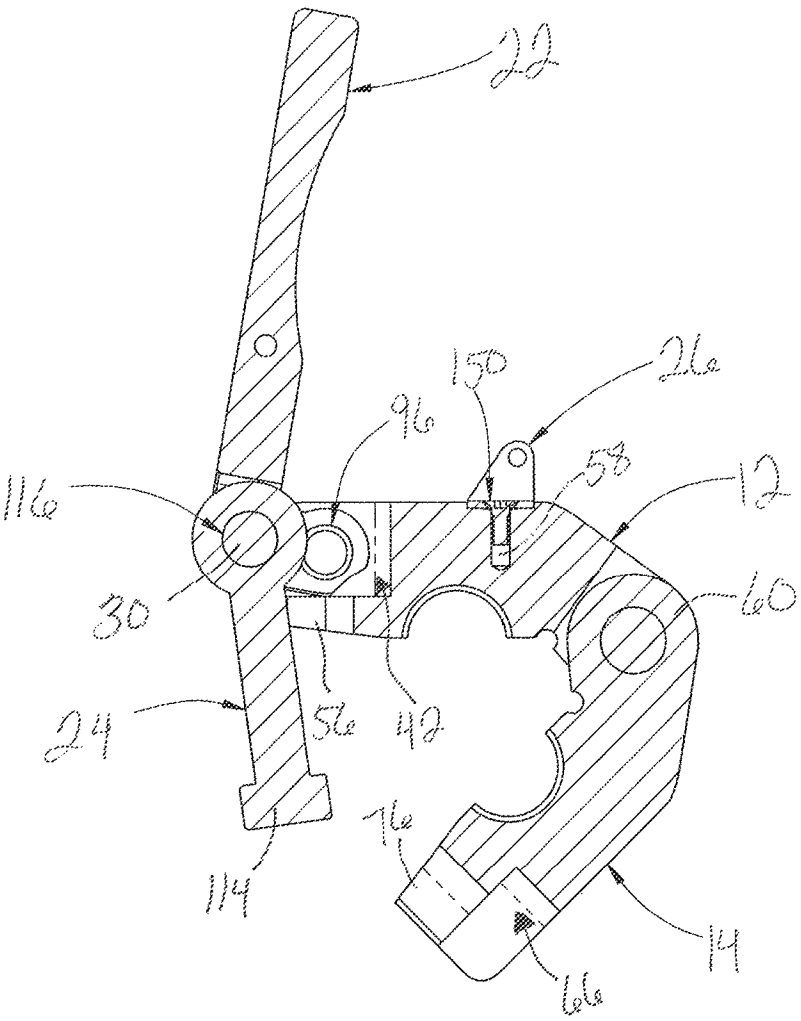
FIG. 16 is a sectional view of the rod clamp assembly in the open position taken along line B-B in FIG. 14.
Figure 17:
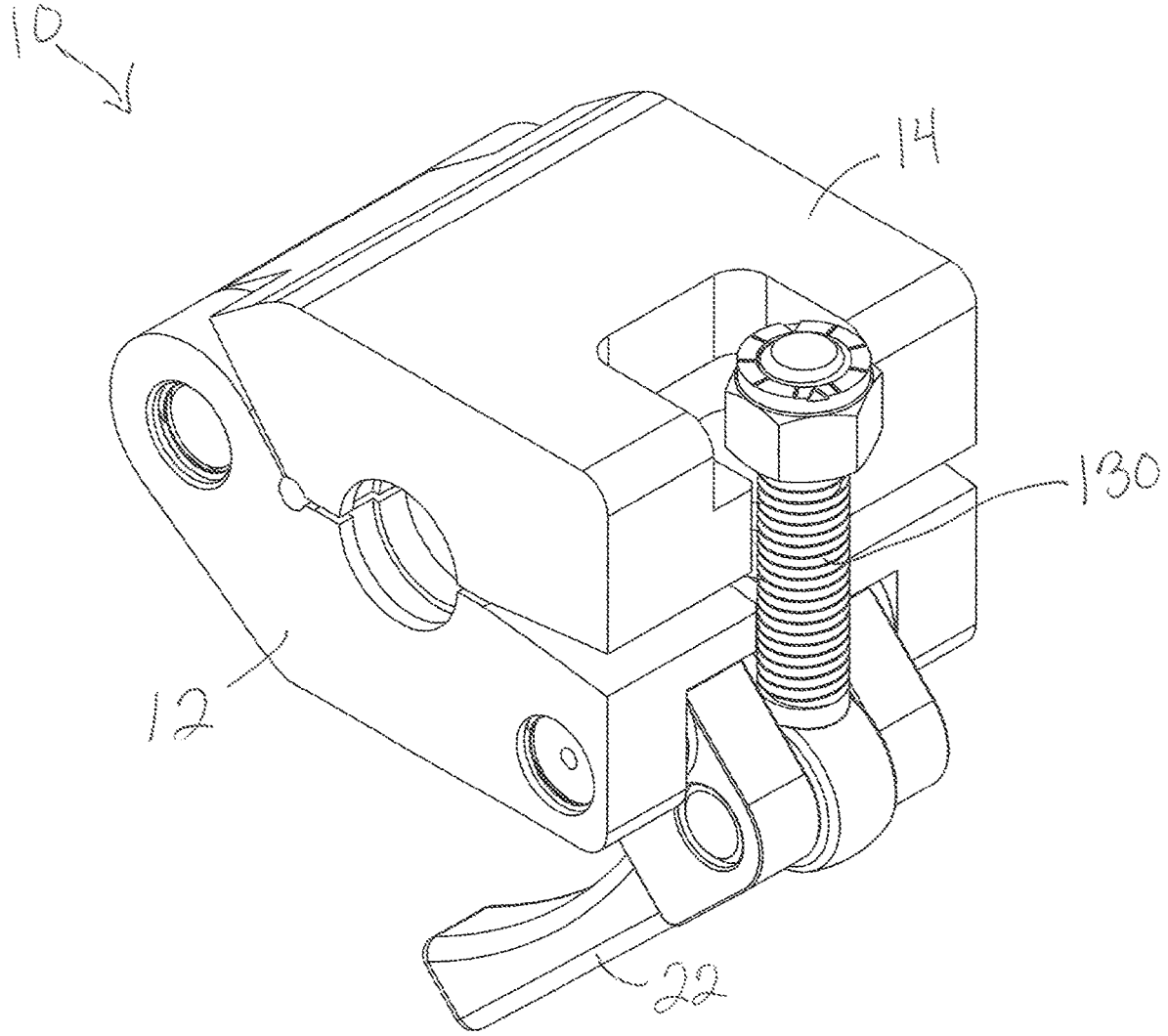
FIG. 17 is a perspective view of the rod clamp assembly in a closed position.

As shown in FIGS. 15 and 16, pin 16 is secured within bore 20 of second clamp member 14 to pivotally secure second clamp member 14 to first clamp member 12. Clamp pin 28 is secured within clamp bore 96 of prong 88 of handle 22 to pivotally secure handle base 82 to first clamp member 12. Pin 30 is secured within bore 94 of prong 88 and through central bore 116 of lock bolt 24 to pivotally secure lock bolt 24 to handle base 82. Fastener 150 is secured in aperture 58 of first clamp member 12 to secure bracket 140 of safety lock assembly 26 to first clamp member 12. In one embodiment, base plate 146 of bracket 140 is also disposed within an upper portion of aperture 58 in first clamp member 12. With reference to FIG. 15, round profile surface 102 engages receptacle floor 50 of first clamp member 12. In the open position, first inflection line 106 engages receptacle floor 50.

FIGS. 17-20 illustrate rod clamp assembly 10 in a closed position. The embodiment illustrated in FIG. 17 includes alternate lock bolt 130, while the embodiments illustrated in FIGS. 18-20 include lock bolt 24. As shown, lock bolt 24 and alternate lock bolt 130 may be used interchangeably in rod clamp assembly 10.

Rod clamp assembly 10 may be placed in the closed position by pulling together distal surfaces 40 and 65 of first and second clamp members 12 and 14, respectively, to align semi-cylindrical grooves 36 and 62 to form central bore 160 of rod clamp assembly 10. Central bore 160 may be configured to house a portion of a rod therein. Lock end 114 of lock bolt 24 may then be placed in receptacle 66 of second clamp member 14 such that inner surface 120 of lock end 114 engages receptacle floor 74. With lock end 114 in this position, a portion of elongated portion 110 of lock bolt 24 is disposed in recess 56 of first clamp member 12 and recess 76 in second clamp member 14.

Figure 19:
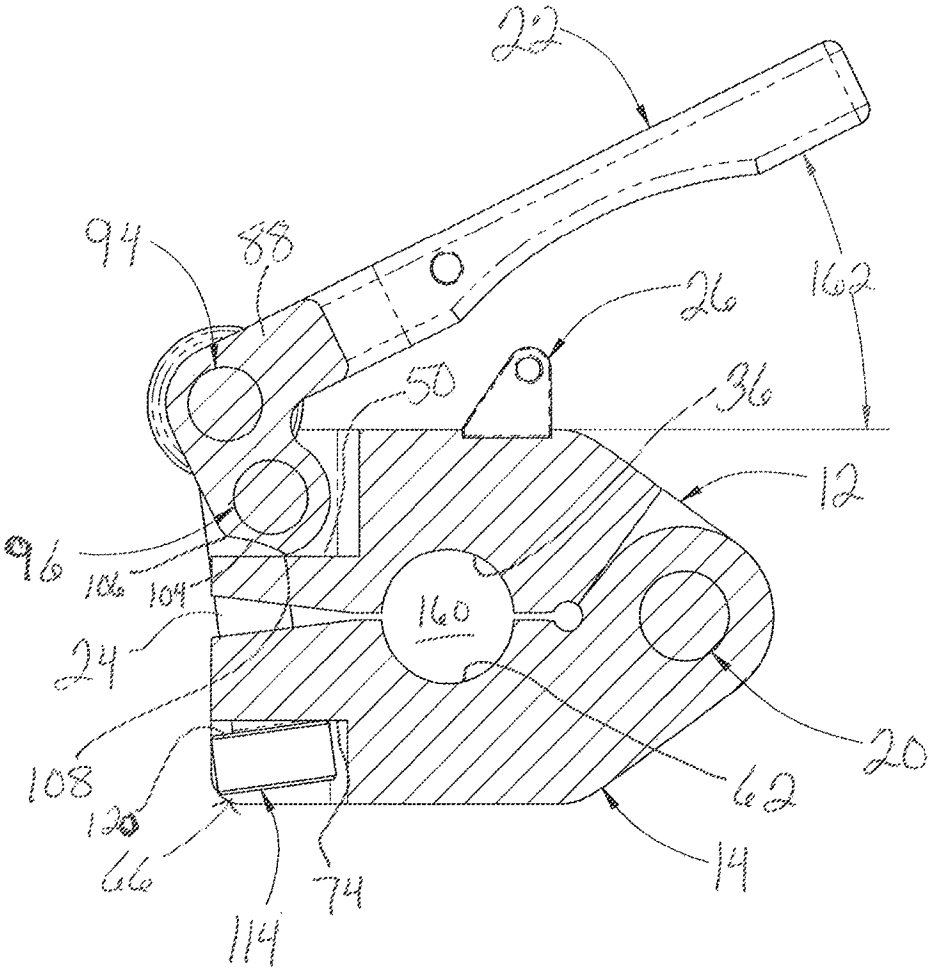
FIG. 19 is a sectional view of the rod clamp assembly in the closed position, taken along line A-A in FIG. 18.
Figure 18:
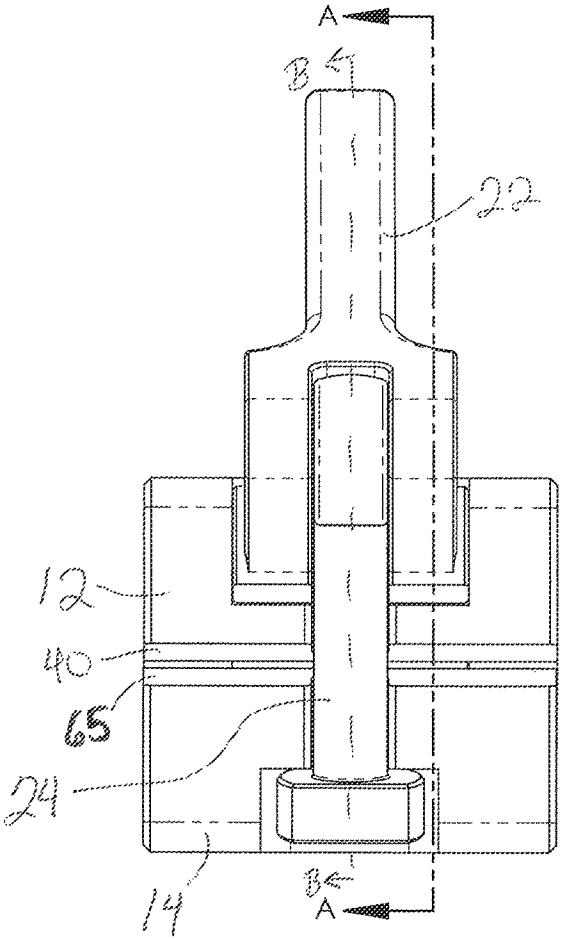
FIG. 18 is an end view of the rod clamp assembly in the closed position.
Figure 20:
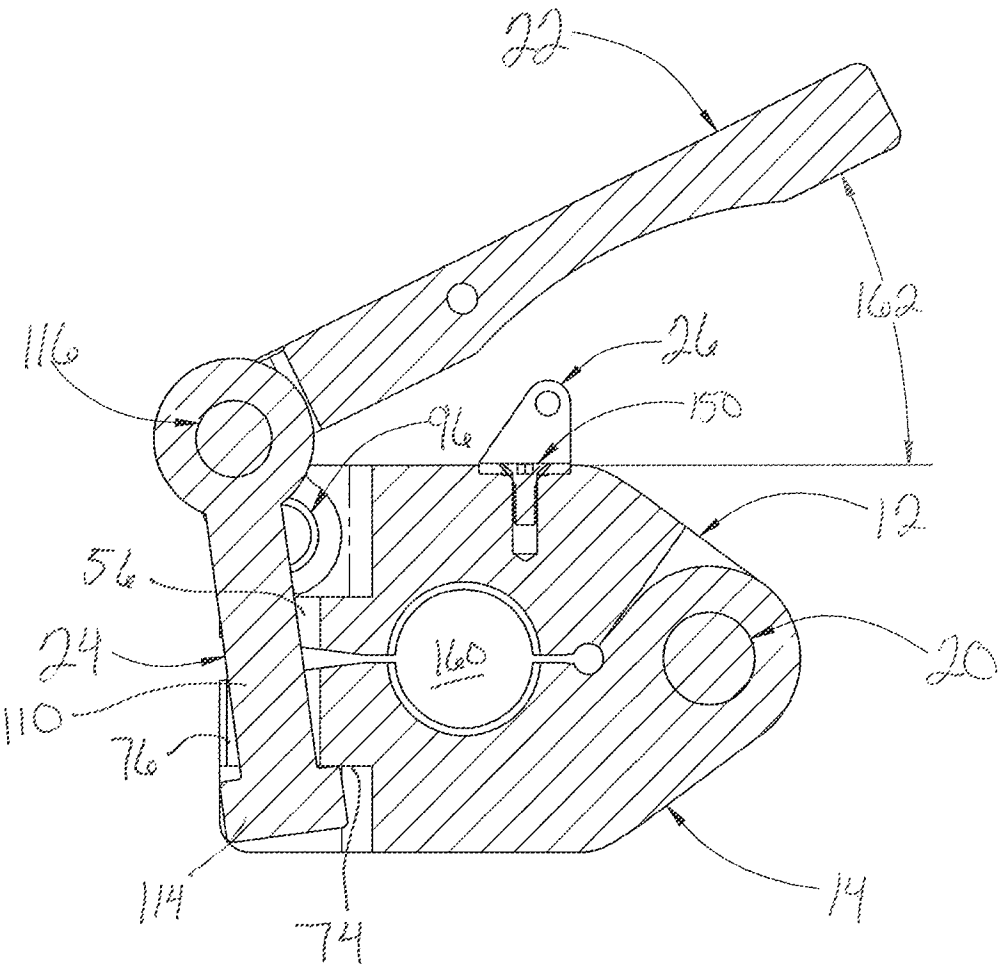
FIG. 20 is a sectional view of the rod clamp assembly in the closed position taken along line B-B in FIG. 18.
Figure 21:
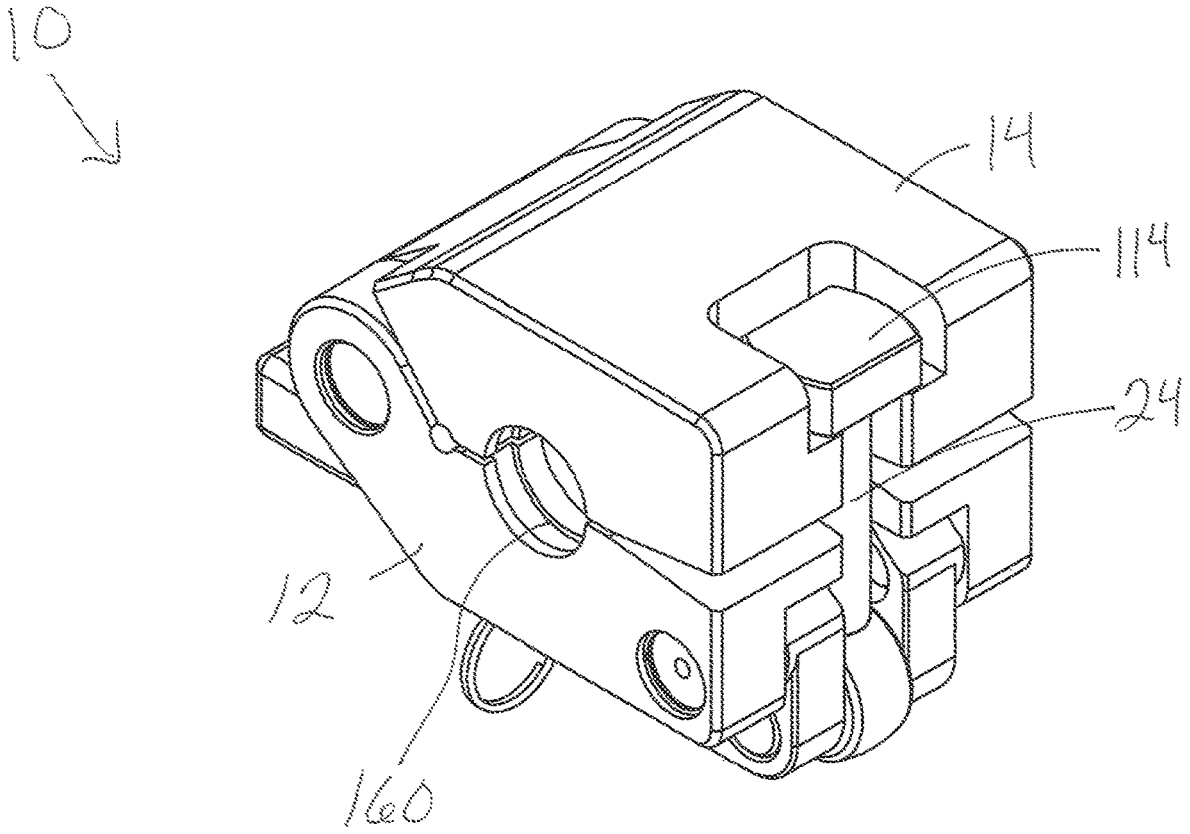
FIG. 21 is a perspective view of the rod clamp assembly in a locked position.
Figure 23:
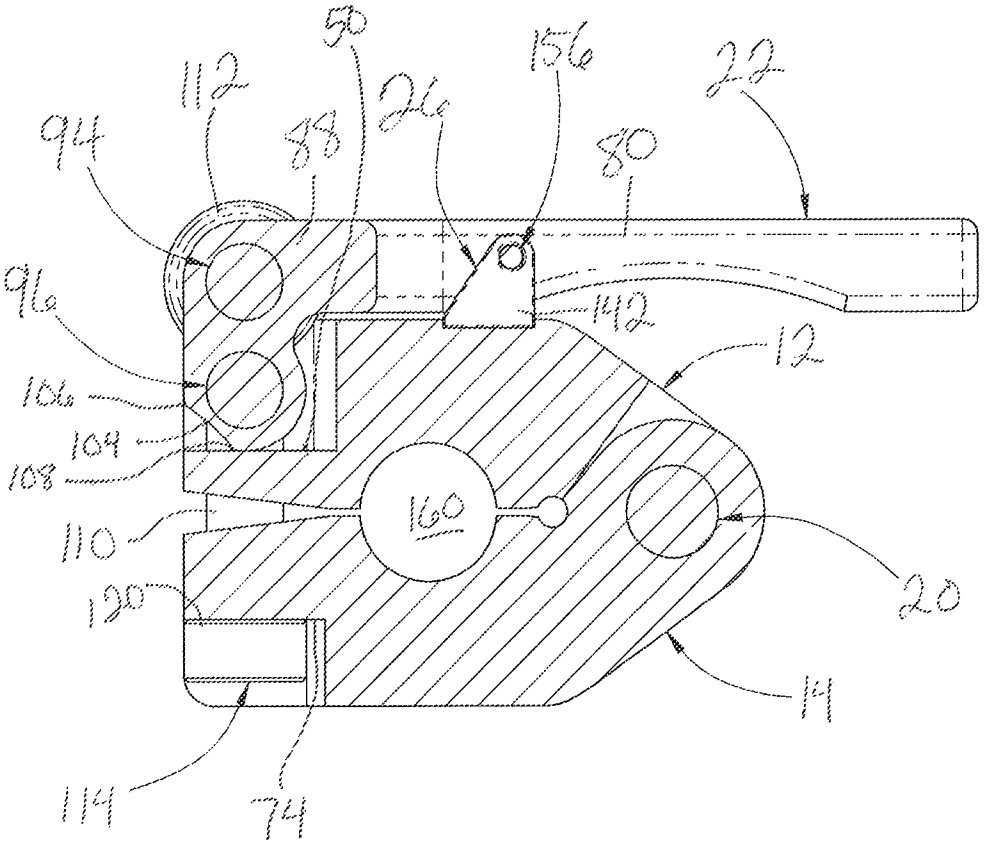
FIG. 23 is a sectional view of the rod clamp assembly in the locked position, taken along line A-A in FIG. 22.
Figure 22:
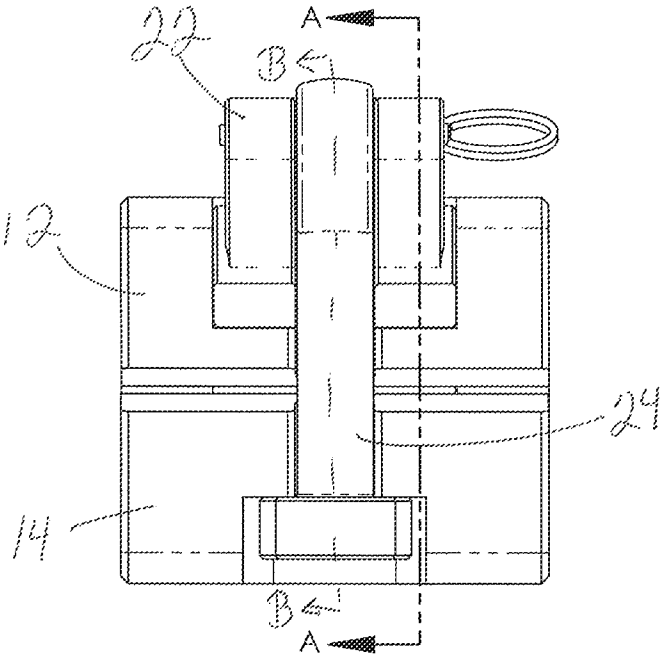
FIG. 22 is an end view of the rod clamp assembly in the locked position.
Figure 24:
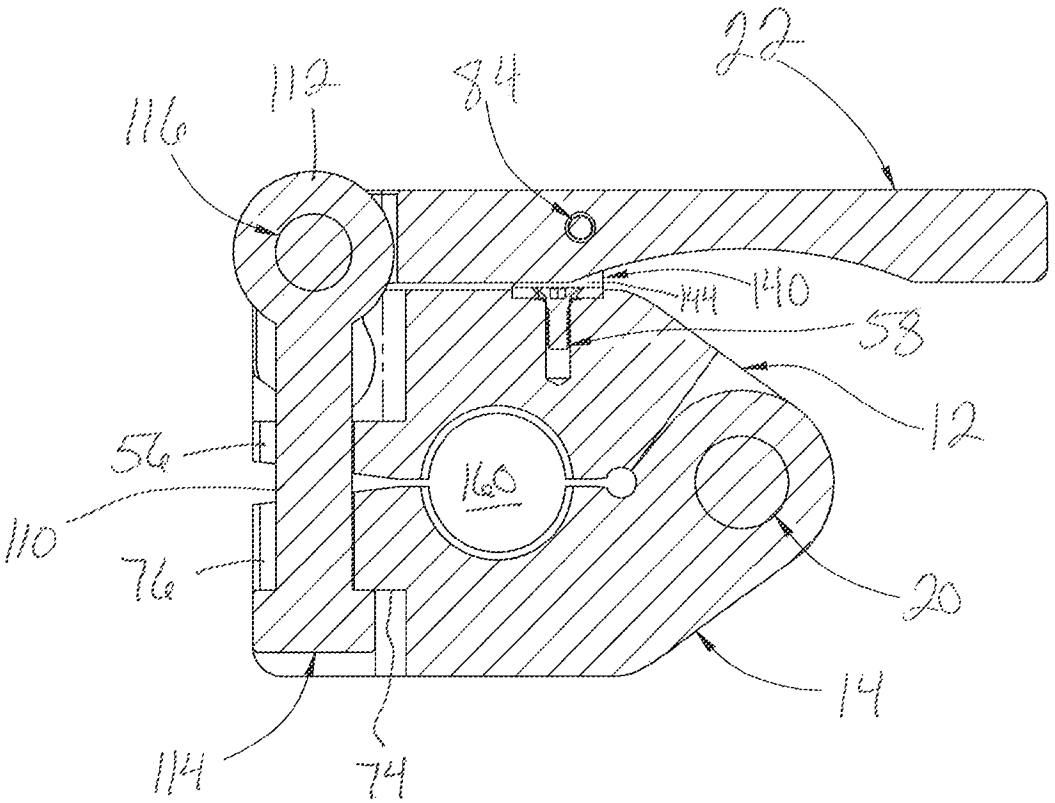
FIG. 24 is a sectional view of the rod clamp assembly in the locked position taken along line B-B in FIG. 22.

Handle 22 may be rotated from the position shown FIGS. 15 and 16 to a position that is angle 162 from first clamp member 12 shown in FIGS. 18 and 19. In one embodiment, angle 162 is between 10 and 40 degrees, or any subrange therein. In another embodiment, angle 162 is between 15 and 35 degrees, or any subrange therein. In another embodiment, angle 162 is between 20 and 30 degrees. In yet another embodiment, angle 162 may be about 26 degrees. There is no resistance to the movement of handle 22 from the position in which first inflection line 106 engages receptacle floor 50 of first clamp member 12 (as shown in FIG. 15) to the position in which second inflection line 108 engages receptacle floor 50 of first clamp member 12 (as shown in FIG. 19). In other words, notch 104 provides for free movement of handle 22 between these two positions.

FIGS. 21-24 illustrate rod clamp assembly 10 in a locked position. In this position, lock end 114 of lock bolt 24 engages receptacle floor 50 of first clamp member 12 with inner surface 120 of lock end 114 parallel to receptacle floor 74 of second clamp member 14. Elongated portion 110 of lock bolt 24 is completely disposed within recesses 56 and 76 of first and second clamp members 12 and 14, respectively. Handle 22 has been rotated into a position in which elongated portion 80 is parallel to first clamp member 12. This rotation of handle 22 requires a locking force to be applied to elongated portion 80 in order to force round profile surface 102 to rotationally slide beyond second inflection line 108 on receptacle floor 50. The locking force may be in the range of 100 to 250 lbs., or any subrange therein. In another embodiment, the locking force may be in the range of 50 to 100 lbs., or any subrange therein. Use of a cheat bar may reduce the locking force required of a user by about 80%.

With handle 22 parallel to first clamp member 12, elongated portion 80 is disposed between first and second segments 142 and 144 of bracket 140 with lateral bore 84 of handle 22 aligned with bores 152 and 154 of first and second segments 142 and 144, respectively. Safety pin 156 may then be positioned through bores 152 and 154 and through lateral bore 84 to lock handle 22 in the locked position as shown.

With rod clamp assembly 10 in the open position shown in FIGS. 13-16, first and second clamp members 12 and 14 may be positioned around a rod, such as a polished rod of a reciprocating piston pump, by positioning the rod in semi-cylindrical grooves 36 and 62 of first and second clamp members 12 and 14, respectively. First and second clamp members 12 and 14 may be pivoted into the closed position shown in FIGS. 17-20 by drawing the distal surfaces 40 and 65 of first and second clamp members 12 and 14, respectively, toward one another, and rotating lock bolt 24 to position lock end 114 in receptacle 66 of second clamp member 14. Rotating handle 22 into a position in which second inflection line 108 engages receptacle floor 50 may pull inner surface 120 of lock end 114 into contact with receptacle floor 74. In this way, rod clamp assembly 10 may be placed in a closed position around a rod with the rod positioned in central bore 160. Once second inflection line 108 engages receptacle floor 50 of first clamp member 12 (as shown in FIG. 19), rod clamp assembly 10 grips the rod even before assembly 10 is in the fully locked position shown in FIGS. 21-24.

Further rotation of handle 22 toward first clamp member 12 may draw distal surfaces 40 and 65 of first and second clamp members 12 and 14, respectively, toward one another until rod clamp assembly 10 is in the locked position shown in FIGS. 21-24. In this way, rod clamp assembly 10 grips the rod disposed in central bore 160. Grips 38 and 64 (shown in FIGS. 4 and 6) may enhance the gripping strength of rod clamp assembly 10. The rotation of handle 22 between the closed position and the locked position requires the locking force described above. Safety pin 156 may then engage lateral bore 84 of handle 22 to lock handle 22 in the locked position.

In the locked position, rod clamp assembly 10 is more stable than conventional assemblies. Due to the presence of notch 104, there is no constant force tending to rotate handle 22 out of the locked position. Notch 104 provides a "snap" close or quick close and a "snap" open or quick open process for the rod clamp assembly 10 that decreases the safety risks associated with its installation on polished rods. Notch 104 reduces the opening forces associated with moving the handle 22 from the locked position to the closed and open positions. The time required to lock rod clamp assembly 10 on a rod is less than one minute. This drastically reduces the installation time over convention rod clamps, which require up to 30 minutes to install. Additionally, all components of rod clamp assembly 10 are secured to one another; there are no loose pieces. This design provides safety benefits due to the lack of free components that may fall from an elevated height presenting safety risks. Rod clamp assembly 10 reduces the assembly time, saves maintenance costs, provides quick setting and easy handling, and reduces the use of handling tools.

Figure 25:
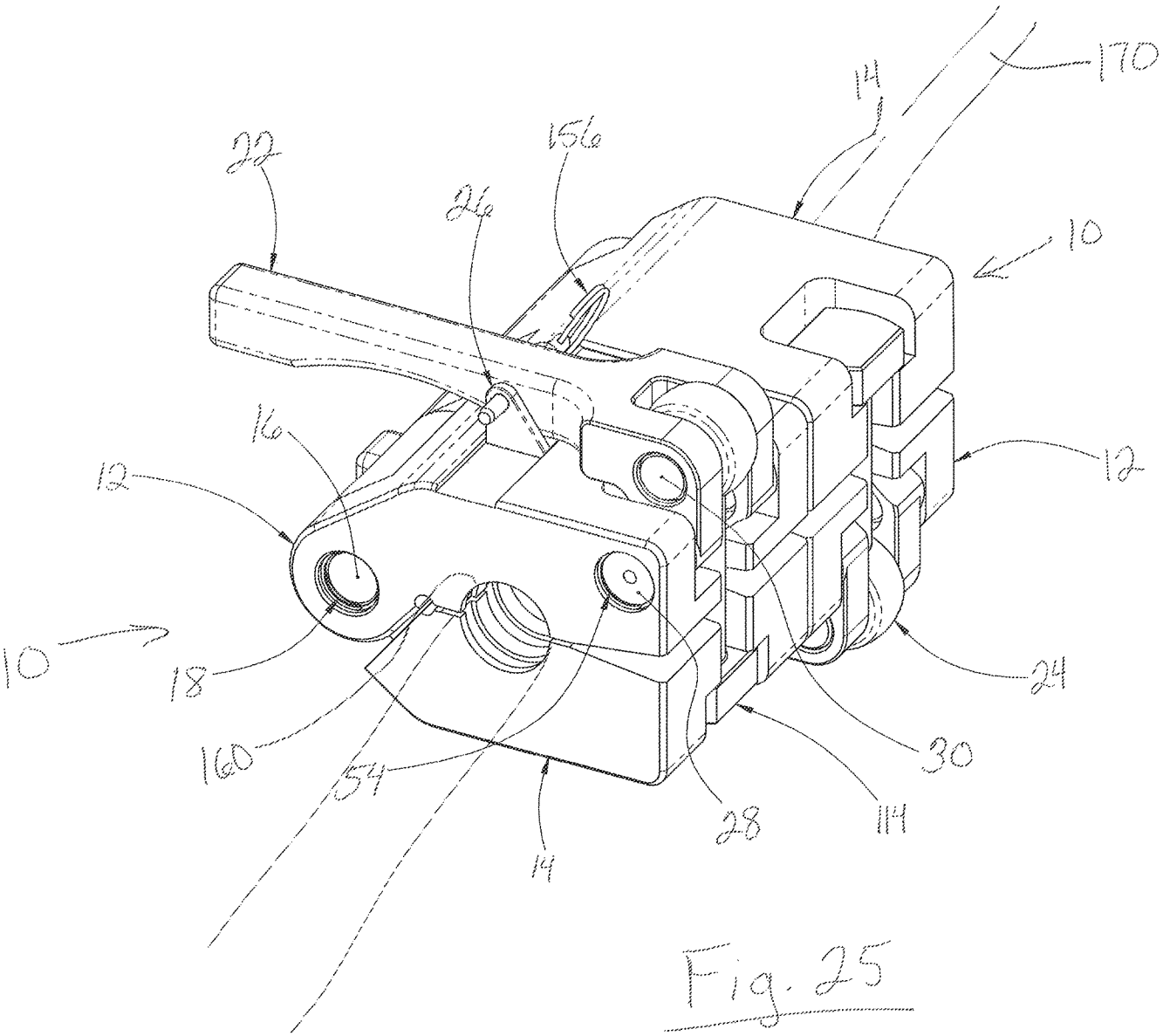
FIG. 25 is a perspective view of two rod clamp assemblies in the locked position on a rod.

With reference to FIG. 25, two or more combined rod clamp assemblies 10 may be placed in the locked position on a single rod, such as rod 170, which is disposed through central bore 160 of each rod clamp assembly 10. Use of more than one rod clamp assembly 10 provides greater strength of connection and provides additional closing force to sustain a heavier sucker rod string weight. In other words, using more than one rod clamp assembly 10 allows the clamps to hold a heavier load. As shown, the orientation of the rod clamp assemblies 10 may be alternated to allow for clear visibility of opening and closing of each handle. A single rod clamp assembly 10 may be configured to hold a load of 20,000 lbs. to 25,000 lbs. A double clamp including two rod clamp assemblies 10 may be configured to hold a load of 40,000 lbs. to 50,000 lbs. A triple clamp including three rod clamp assemblies 10 may be configured to hold a load of 65,000 lbs. to 75,000 lbs. Rod clamp assembly 10 may be configured to engage and grip a rod having a diameter of 0.5 inches to 5 inches, or any subrange therein. In another embodiment, rod clamp assembly 10 may be configured to engage and grip a rod having a diameter of 1 inch to 2 inches, or any subrange therein.

Each of the components of rod clamp assembly 10 may be formed of a metal, a plastic, or a hard composite material.

Figure 26:
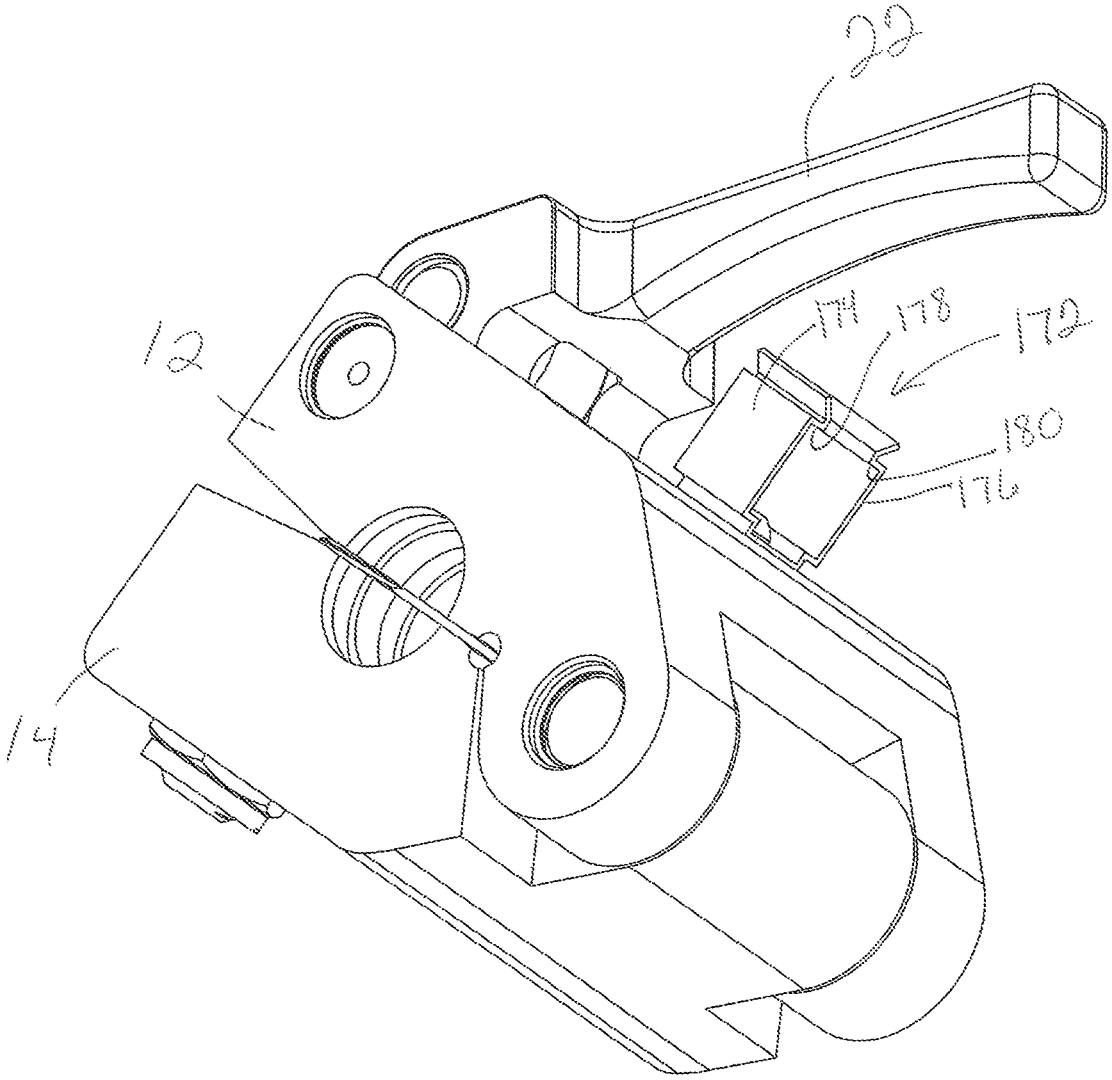
FIG. 26 is a perspective view of a rod clamp assembly including an alternate embodiment of the safety lock assembly.

FIG. 26 illustrates rod clamp assembly 10 an alternate embodiment of the safety lock assembly. Safety lock assembly 172 is secured to first clamp member 12. Safety lock assembly 172 includes a bracket including first segment 174 and second segment 176. First and second segments 174 and 176 include shoulders 178 and 180, respectively. When handle 22 is rotated into the locked position, elongated portion 80 of handle 22 is forced between first and second segments 174 and 176 of safety lock assembly 172, which expand outward slightly to allow handle 22 to slide between. When handle 22 reaches the locked position, first and second segments 174 and 176 retract around handle 22 such that shoulders 178 and 180 retain handle 22 within safety lock assembly 172. In this way, safety lock assembly 172 provides a bracket that automatically engages elongated portion 80 of handle 22 in the locked position.

As used herein, "above," "top," "upper," or any other indication of a greater height or latitude, and "below," "bottom," "lower," or any other indication of a lesser height or latitude shall each also mean the opposite directional phrase in reference to the rod clamp assembly, which may be positioned in any direction on a rod. As used herein, "pivot" or "pivotally connected" shall also include any other rotation or any other connection that allows for relative rotation between the connected components.

Each assembly described herein may include any combination of the described components, features, and/or functions of each of the individual assembly embodiments. Each method described herein may include any combination of the described steps in any order, including the absence of certain described steps and combinations of steps used in separate embodiments. Any range of numeric values disclosed herein shall be construed to include any subrange therein.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A rod clamp assembly comprising:

a first clamp member pivotally connected to a second clamp member, the first and second clamp members each including a semi-cylindrical groove, wherein in a locked position the semi-cylindrical grooves align to form a central bore dimensioned to receive a rod;

a handle directly pivotally connected to the first clamp member; and a lock bolt directly pivotally connected to the handle, wherein the lock bolt includes a lock end, wherein in an open position the lock bolt does not engage the second clamp member, wherein in a closed position the lock end of the lock bolt engages a receptacle of the second clamp member to pull the first and second clamp members together, and wherein applying a locking force on the handle in the closed position rotates the handle to secure the first and second clamp members together in the locked position.

2. The rod clamp assembly of claim 1, wherein the first clamp member includes a receptacle defined by two side walls and a rear wall each extending from a receptacle floor.

3. The rod clamp assembly of claim 2, wherein the handle includes a handle base and an elongated portion extending from the handle base, wherein the handle base is partially disposed in the receptacle of the first clamp member.

4. The rod clamp assembly of claim 3, wherein the handle base includes a notch configured to engage the receptacle floor of the first clamp member to provide a snap close and a snap open function.

5. The rod clamp assembly of claim 3, wherein the handle base includes two prongs separated by a central space, wherein each prong includes a lock bolt bore and a clamp bore, wherein the clamp bore of each prong is aligned with a bore in each of the side walls of the receptacle of the first clamp member, and wherein each of the prongs of the handle base includes a notch proximate the clamp bore, wherein each of the notches is configured to engage the receptacle floor of the first clamp member to provide a snap close and a snap open function.

6. The rod clamp assembly of claim 5, further comprising two clamp pins each disposed through the bore in one of the side walls of the receptacle of the first clamp member and through the clamp bore of one of the prongs of the handle base to pivotally connect the handle to the first clamp member.

7. The rod clamp assembly of claim 5, wherein each prong of the handle base includes a generally round profile surface surrounding the clamp bore, and wherein the notch is formed by a concave surface extending from a first inflection line to a second inflection line on the generally round profile surface.

8. The rod clamp assembly of claim 5, wherein the lock bolt includes an elongated portion extending from a lock base to the lock end, wherein the lock base is disposed in the central space between the two prongs of the handle base, wherein the lock base includes a central bore aligned with the lock bolt bores of each prong of the handle base, wherein the elongated portion of the lock bolt is partially housed in a recess of the first clamp member and a recess of the second clamp member in the locked position.

9. The rod clamp assembly of claim 8, further comprising a pin secured through the central bore of the lock base and through each of the lock bolt bores in the prong of the handle base to pivotally connect the lock bolt to the handle.

10. The rod clamp assembly of claim 8, wherein the elongated portion of the lock bolt includes a threaded outer surface, and wherein the lock end of the lock bolt includes a nut threadedly secured to the threaded outer surface of the elongated portion.

11. The rod clamp assembly of claim 8, wherein the elongated portion of the lock bolt is integrally formed with the lock base and the lock end.

12. The rod clamp assembly of claim 3, further comprising a safety lock assembly selectively engaging the elongated portion of the handle to secure the handle in the locked position.

13. The rod clamp assembly of claim 12, wherein the safety lock assembly includes a bracket secured to the first clamp member, wherein the bracket includes two spaced apart segments each including a bore, wherein the elongated portion of the handle is disposed between the two spaced apart segments in the locked position.

14. The rod clamp assembly of claim 13, wherein the elongated portion of the handle includes a lateral bore that is aligned with the bores in the two spaced apart segments of the safety lock assembly when the handle is in the locked position.

15. The rod clamp assembly of claim 14, wherein the safety lock assembly further includes a safety pin disposed through the bores in the two spaced apart segments of the safety lock assembly and through the lateral bore of the elongated portion of the handle in the locked position.

16. The rod clamp assembly of claim 12, wherein the safety lock assembly includes a bracket configured to automatically engage the elongated portion of the handle in the locked position.

17. The rod clamp assembly of claim 1, wherein the semi-cylindrical grooves of the first and second clamp members each includes a grip section on an inner surface.

18. A method of securing a rod clamp assembly on a rod, comprising the steps of:

a) providing a rod clamp assembly comprising: a first clamp member pivotally connected to a second clamp member, the first and second clamp members each including a semi-cylindrical groove, wherein in a locked position the semi-cylindrical grooves align to form a central bore dimensioned to receive a rod; a handle directly pivotally connected to the first clamp member; and a lock bolt directly pivotally connected to the handle, wherein the lock bolt includes a lock end;

b) positioning the rod clamp assembly in an open position around a rod by placing the rod in the semi-cylindrical grooves of the first and second clamp members, wherein in the open position the lock bolt does not engage the second clamp member;

c) rotating the lock bolt such that the lock end of the lock bolt engages a receptacle of the second clamp member to pull the first and second clamp members together in a closed position; and d) applying a locking force on the handle to rotate the handle into the locked position in which an inner surface of the lock end of the lock bolt fully engages a receptacle floor of the receptacle of the second clamp member.

19. The method of claim 18, wherein the handle includes a handle base including a notch and an elongated portion extending from the handle base, wherein the handle base is partially disposed in a receptacle of the first clamp member, wherein step (c) further comprises gripping a receptacle floor of the receptacle of the first clamp member with an inflection line of the notch of the handle base to hold the rod in the semi-cylindrical grooves of the first and second clamp members before the rod clamp assembly is in the locked position.

20. The method of claim 19, wherein the rod clamp assembly further comprises a safety lock assembly including a bracket secured to the first clamp member, wherein the bracket includes two spaced apart segments each including a bore, wherein the elongated portion of the handle includes a lateral bore; wherein in step (d) the elongated portion of the handle is disposed between the two spaced apart segments of the bracket of the safety lock assembly in the locked position, with the lateral bore of the handle aligned with the bores in the two spaced apart segments; and wherein the method further comprises:

e) securing a safety pin through the bores of each of the spaced apart segments of the safety lock assembly and through the lateral bore of the handle to secure the handle in the locked position.

* * * * *